US007134407B1

(12) United States Patent
Nelson

(10) Patent No.: US 7,134,407 B1
(45) Date of Patent: Nov. 14, 2006

(54) V-QUAD ENGINE AND METHOD OF CONSTRUCTING SAME

(76) Inventor: Gregory J. Nelson, 7212 Lincoln Newcastle Hwy., Newcastle, CA (US) 95658

( * ) Notice: Subject to any disclaimer, the term of this patent is extended or adjusted under 35 U.S.C. 154(b) by 0 days.

(21) Appl. No.: 11/136,081

(22) Filed: May 23, 2005

(51) Int. Cl.
*F02B 75/22* (2006.01)

(52) U.S. Cl. ..... 123/54.4; 123/594

(58) Field of Classification Search ..... 123/54.4, 123/594
See application file for complete search history.

(56) References Cited

U.S. PATENT DOCUMENTS

| | | | | |
|---|---|---|---|---|
| 2,111,242 | A | | 3/1938 | Harley |
| 3,738,338 | A | | 6/1973 | Wickman |
| 3,851,631 | A | | 12/1974 | Kiekhaefer |
| 4,129,103 | A | | 12/1978 | Pichl |
| 4,135,478 | A | | 1/1979 | Rassey |
| 4,327,811 | A | * | 5/1982 | Isaka ..... 123/54.4 |
| 4,399,777 | A | | 8/1983 | Hoettels |
| 4,793,300 | A | | 12/1988 | Kadoshima et al. |
| 5,615,642 | A | | 4/1997 | Coughlin |
| 5,743,219 | A | | 4/1998 | Iio et al. |
| 5,950,579 | A | | 9/1999 | Ott |
| 6,138,635 | A | | 10/2000 | Walker |
| 6,257,178 | B1 | | 7/2001 | Laimbock |
| 6,321,698 | B1 | | 11/2001 | Rau et al. |
| 6,439,185 | B1 | | 8/2002 | Tosaka et al. |

* cited by examiner

*Primary Examiner*—Noah P. Kamen
(74) *Attorney, Agent, or Firm*—Cochran Freund & Young LLC; James R. Young

(57) ABSTRACT

A V-quad engine has two juxtaposed V-twin cylinder banks connected to a common crankshaft and fuel and ignition systems that cause the front cylinders in the two banks to fire simultaneously and the rear cylinders in the two banks to fire simultaneously. Conventional V-twin components are used for many components of the V-quad engine. Master-slave rocker shaft assemblies are provided with angularly adjustable links to drive the left bank rocker shafts in unison with the right bank rocker shafts.

24 Claims, 9 Drawing Sheets

V-QUAD ENGINE AND METHOD OF CONSTRUCTING SAME

BACKGROUND OF THE INVENTION

1. Field of the Invention

The present invention is related generally to internal combustion engines, and, more specifically, to a V-type, internal, combustion engine in which at least two V-type cylinder banks, each of which comprises two co-planar, V-oriented cylinders containing pistons, all of which are connected to a common crankshaft on a common, eccentric crank axis and are synchronized in such a manner that at least one of the cylinders in each of the V-type cylinder banks fires simultaneously with at least one of the cylinders in another of the V-type cylinder banks.

2. State of the Prior Art

V-twin engines are generally two-cylinder, V-type engines in which the longitudinal axes of the two cylinders form a V in a plane that is perpendicular to the crankshaft, exemplified by the engines shown in, for example, U.S. Pat. Nos. 2,111,242, 5,615,642, and 5,950,579, all of which are incorporated herein by reference. V-twin engines are commonly used to power motorcycles. In fact, such V-twin engines, which have been manufactured for many years by Harley-Davidson Motor Co., of Milwaukee, Wis., and by other engine manufacturers, have become so popular with motorcycle enthusiasts, that the V-twin shape and even the distinctive exhaust sound and rhythm of such engines, are widely regarded as highly desirable features. At the same time, it is also popular among a subset of motorcycle enthusiasts to modify or customize motorcycles, especially motorcycles manufactured by Harley-Davidson Motor Co.—-often called "Harley-type" motorcycles—to create or obtain more distinctive appearances or features than the conventional factory-produced motorcycles, while still maintaining some degree of identity or commonality with the conventional factory produced motorcycles, such as the appearance and sound of the original V-twin engine, especially the "Harley V-Twin" (trademark) engine.

An adjunct to such motorcycle customizing activities often includes modifying the V-twin engines or building or acquiring customized substitutes, usually with the goal of making them more powerful than the original factory production V-twin engines while maintaining as much as possible the appearance, sound, and rhythm characteristics of the original Harley V-Twin engines. In fact, such endeavors have spawned and encouraged the growth of secondary industries that not only design and make customized Harley-type motorcycles, but also myriad components, including modified or customized V-twin engines, for such custom motorcycle enthusiasts. However, to obtain a significant increase in power over production V-twin engines, while still maintaining substantially the same appearance and sound and that can be mounted without substantial modifications to Harley-type motorcycle frames, transmissions, and the like, has required essentially custom designing and manufacturing entire engines, which can be too time-consuming and too expensive to do on a custom basis. Therefore, there is a need and desire for a less expensive and less time-consuming way to make a large-displacement, more powerful custom motorcycle engine that has a similar appearance and substantially the same sound and rhythm as a classic V-twin engine, especially such as those manufactured by Harley-Davidson Motor Co., and that can be mounted in a Harley-type motorcycle without extensive modifications to the frame, transmission, or other components.

SUMMARY OF THE INVENTION

Accordingly, a general object of this invention is to provide a large-displacement, V-type motorcycle engine that has a similar appearance and substantially the same sound and rhythm as a Harley V-Twin engine.

A more specific object of this invention is to provide a large-displacement, V-Type motorcycle engine that has a similar appearance and substantially the same sound as a Harley V-Twin engine and that can be made with a high percentage of standard V-twin engine parts.

To achieve these and other objects of the invention, a V-quad engine is made with two juxtaposed V-twin cylinder banks connected to a common crankshaft and with a firing system that causes the front cylinders in the two banks to fire simultaneously and the rear cylinders in the two banks to fire simultaneously. Other features and details of the invention are explained below.

BRIEF DESCRIPTION OF THE DRAWINGS

The accompanying drawings, which are incorporated in and form a part of the specification, illustrate the preferred embodiments of the present invention, and together with the written description and claims, serve to explain the principles of the invention. In the drawings:

DETAILED DESCRIPTION OF THE PREFERRED EMBODIMENTS

Figure 1:
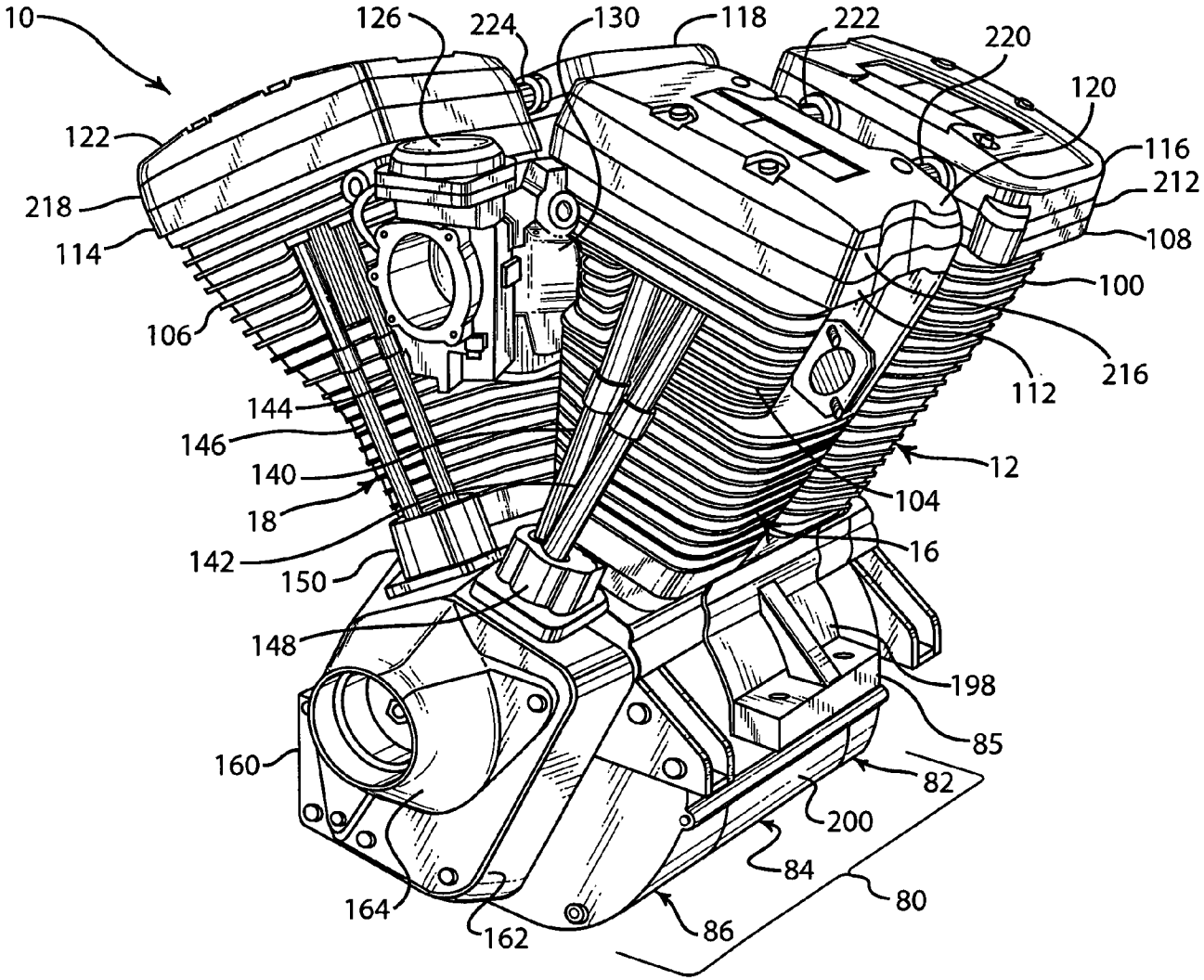
FIG. 1 is a perspective view of a V-quad engine of this invention.

A V-quad engine 10 according to this invention is shown in FIG. 1 from an upper right perspective so that the front and right side of the engine 10 are visible in FIG. 1. The V-quad engine 10 can be mounted and used in any orientation, but the terms front, left, and right are used for convenience in this description and generally correspond with how the engine could be mounted and used in a motorcycle (not shown).

The V-quad engine 10 comprises two banks of two co-planar cylinders in each bank—a left bank comprised of a left front cylinder 12 and a left rear cylinder 14, and a right bank comprised of a right front cylinder 16 and a right rear cylinder 18. As illustrated diagrammatically in FIG. 2, which has substantially the same orientation as FIG. 1, the cylinders 12, 14, which comprise the left cylinder bank, each have a cylinder longitudinal axis 12', 14' that, together, form a V in a plane 20 that is transverse, i.e., perpendicular, to the longitudinal axis 24 of the crankshaft assembly 30. Likewise, the cylinders 16, 18, which comprise the right cylinder bank, also form a V in another plane 22 that is transverse, i.e., perpendicular, to the crankshaft longitudinal axis 24 and that is spaced a distance 26 apart from the plane 20 in the direction of the crankshaft longitudinal axis 24.

Figure 2:
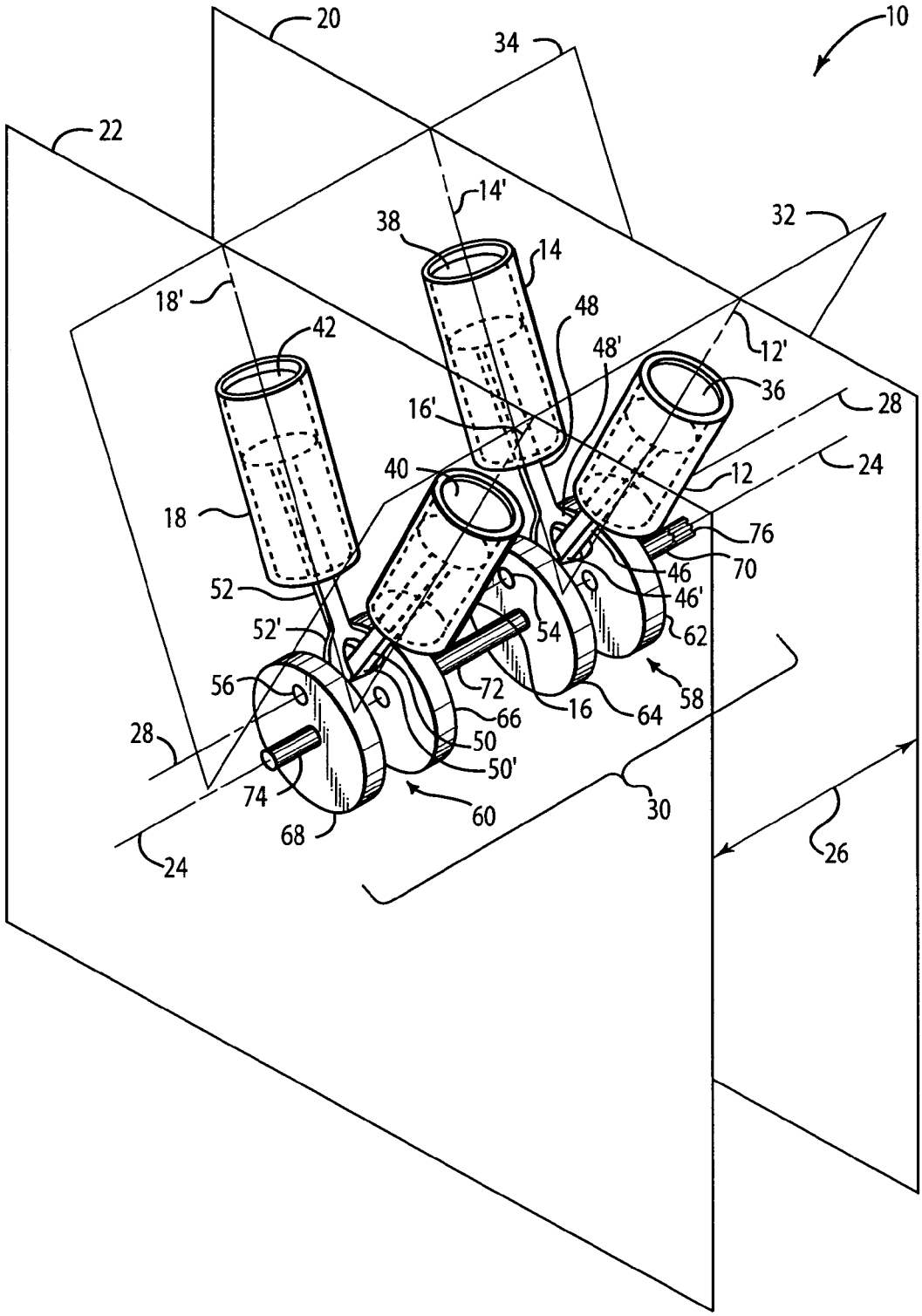
FIG. 2 is a very simplified, diagrammatic, isometric illustration of the co-planar cylinder alignment in the left cylinder bank and in the right cylinder bank of the V-quad engine of this invention in which pistons in both cylinder banks are connected to a common crankshaft at a common, eccentric crank axis.

Further, as also illustrated diagrammatically in FIG. 2, the left front cylinder 12 and the right front cylinder 16 are aligned with each other such that their respective longitudinal axes 12', 16' are parallel to each other, and the left rear cylinder 14 and the right rear cylinder 18 are aligned with each other such that their respective longitudinal axes 14', 18' are parallel to each other. Therefore, the left and right front cylinder axes 12', 16' both lie in a plane 32, and the left and right rear cylinder axes 14', 18' both lie in another plane 34. It is preferred, although not essential, that the planes 32 and 34 also include the crankshaft 24.

In a number of conventional V-twin engines (not shown), the angle between the cylinder longitudinal axes is about 45 degrees, which is often desirable, but not essential. Therefore, if it is desired to make the side profile appearance of the V-quad engine 10 of the present invention mimic the side profile appearance of a conventional V-twin engine, it would be preferable to configure the left and right cylinder banks of the V-quad engine of this invention with the same angle between front and rear cylinder axes 12', 14' and 16', 18', respectively. For example, if it is desired to make the side profile of the V-quad engine of this invention mimic a conventional V-twin engine side profile that has its cylinder longitudinal axes oriented at an angle of 45 degrees to each other, then the angle between the cylinder axes 12', 14' should be oriented at about 45 degrees, and the angle between the cylinder axes 16', 18' should also be about 45 degrees. Therefore, in this example, the front cylinder plane 32 and the rear cylinder plane 34 would be oriented at about 45 degrees to each other, and, preferably, they would intersect each other at the crankshaft longitudinal axis 24.

In addition to the visual appearance that the orientation of the cylinders in a V-twin engine provides, the unique sound and rhythm of a conventional or classic V-twin engine is due in large part to the characteristic connection of the pistons to the crankshaft, i.e., by connecting respective piston connecting rods to the crankshaft at a common, eccentric crank axis, often to a common eccentric crankpin. In other words, the connecting rods of the two pistons in a conventional or classic V-twin engine are not connected to the crankshaft out of phase with each other. They are connected at the same phase, i.e., zero degrees out of phase with each other. However, fuel is drawn into the opposite cylinders (front and rear) and ignited sequentially. In a four cycle engine, each cylinder is fired once for every two revolutions of the crankshaft, i.e., every 720 degrees of rotation. Therefore, in a conventional, four cycle, V-twin engine, a new power stroke in one or the other of the two cylinders acts on the crankshaft at each 360 degrees of crankshaft rotation. Therefore, to mimic the V-twin sound and rhythm with the V-quad engine 10 of this invention, all four pistons 36, 38, 40, 42 are connected to the crankshaft assembly 30 at a common eccentric crank axis 28, as illustrated in FIG. 2. Also, the two front cylinders 12, 16 of the V-quad engine 10 are fired simultaneously with each other, and the rear cylinders 14, 18 are fired simultaneously with each other in order for the V-quad 10 of this invention to maintain substantially the same exhaust sound and rhythm as a conventional V-twin engine.

As indicated above and illustrated diagrammatically in FIG. 2, the pistons 36, 38 in the left bank cylinders 12, 14 are both connected by connecting rods 46, 48 to a left crankpin 54, which along with a right crankpin 56 in this example V-quad engine 10, define the common crank axis 28, which is eccentric to the crankshaft axis 24. Likewise, the pistons 40, 42 in the right bank cylinders 16, 18 are both connected by connecting rods 50, 52 to the right crankpin 56. The connecting rods 46, 48 and 50, 52 can be configured and connected to the respective crankpins 54, 56 in any conventional manner used in V-twin engines, for example, the conventional "fork and knife" configuration, in which the rear connecting rods 48, 52 have bifurcated or "forked" ends 48', 52' and the front connecting rods 46, 50 have straight or "knife" ends 46', 50' that fit between the bifurcated or forked ends 48', 52'. There are two rod bearings (not shown in FIG. 2) between each of the "fork" ends 48' and the left crankpin 54 and one rod bearing (not shown in FIG. 2) between the "knife" end 46' and the left crankpin 54, as is well-known in the art for such "fork and knife" connecting rod configurations. Likewise, there are two rod bearings (not shown in FIG. 2) between the "fork" ends 52' and the right crankpin 56 and one rod bearing (not shown in FIG. 2) between the "knife" end 50' and the right crankpin 56.

The crankshaft assembly 30 in the example V-quad engine 10 can be comprised of two crankshaft subassemblies 58, 60. The left crankshaft subassembly 58 includes two flywheels 62, 64 connected together by the left crankpin 54 on the eccentric crank axis 28 so that the flywheels 62, 64 function as cranks for the reciprocating left pistons 36, 38 to impart rotary motion and power to the left crankshaft segment 70 and center crankshaft segment 72 as well as to maintain inertia. Similarly, the right crankshaft subassembly 60 includes two flywheels 66, 68 connected together by the right crankpin 56 on the eccentric crank axis 28 so that the flywheels 66, 68 function as cranks for the reciprocating right pistons 40, 42 to impart rotary motion and power to the center crankshaft segment 72 and right crankshaft segment 74 as well as to maintain interia. In the example of FIG. 2, the left crankshaft segment 70 is configured, as indicated diagrammatically by the splined end section 76, to output the power of the V-quad engine 10 to a load (not shown), in which case the power exerted by the right bank pistons 40, 42 on the right crankshaft subassembly 60 is added through the center crankshaft section 72 to the power exerted by the left bank pistons 36, 38 on the left crankshaft segment 70 so that the total power exerted by all the pistons 36, 38, 40, 42 is applied to the load (less any internal power consumption by friction and other losses in the engine components, themselves).

Figure 3:
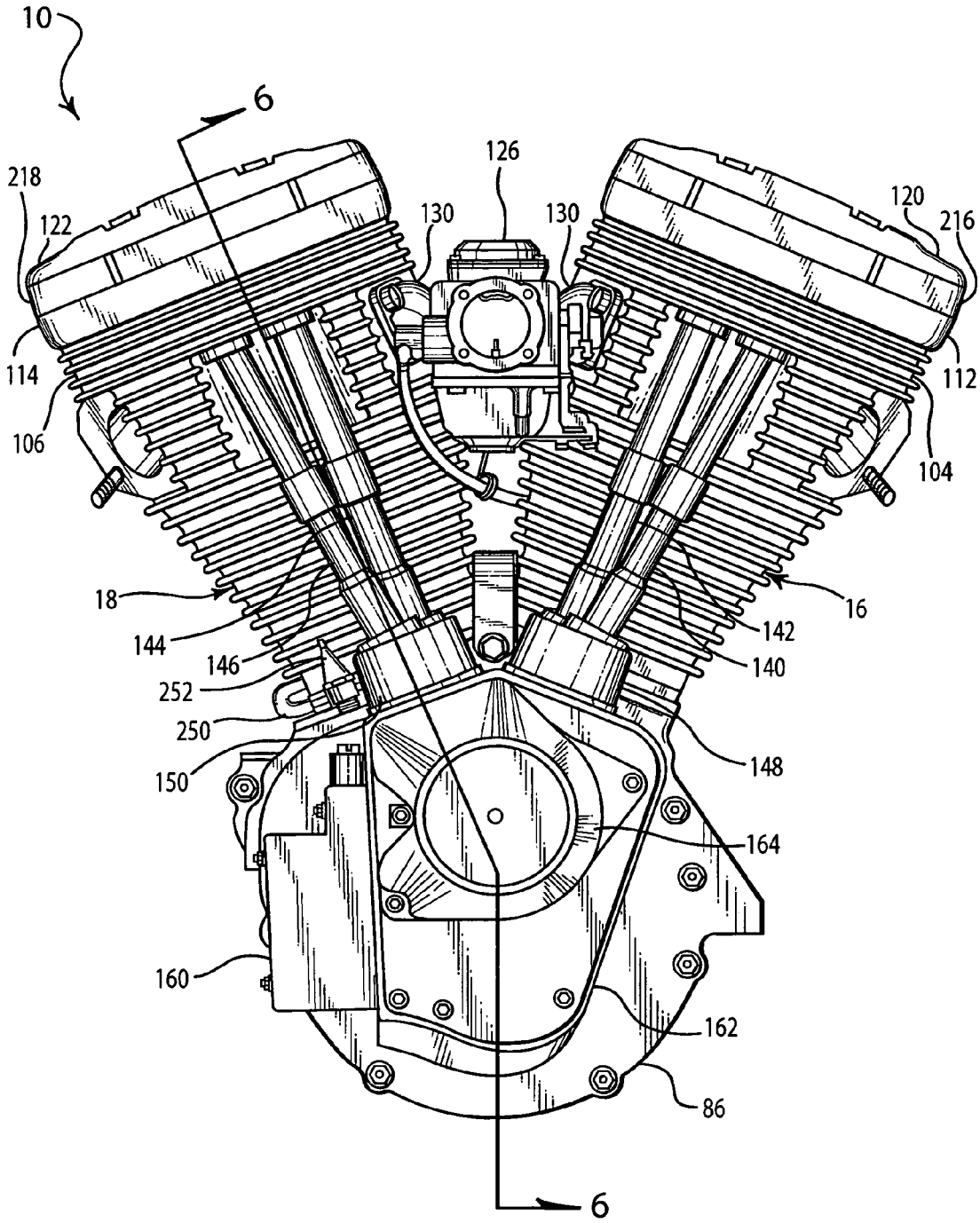
FIG. 3 is a right side elevation view of the V-quad engine in FIG. 1.
Figure 5:
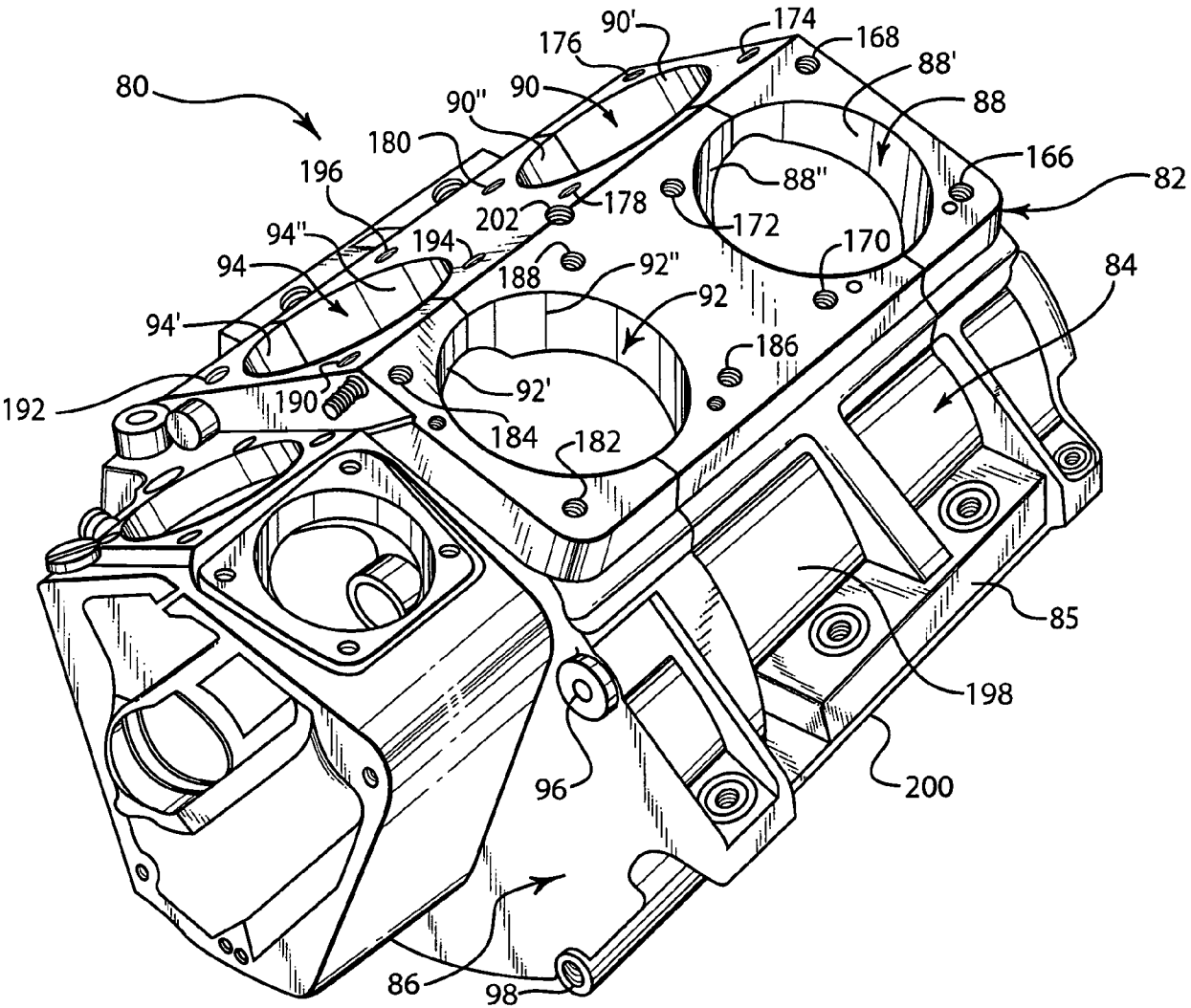
FIG. 5 is a perspective view of a crankcase of the V-quad engine in FIG. 1 showing the cylinder mounting structures.

Referring now primarily to FIGS. 1, 3, and 5, the cylinders 12, 14, 16, 18 are mounted on a crankcase 80. The crankcase 80 is preferably, but not necessarily, comprised of a left crankcase section 82, a center crankcase section 84, and a right crankcase section 86. Some conventional V-twin engines, such as those manufactured by the Harley-Davidson Motor Co., have crankcases that are comprised of a left section and a right section, which when assembled together, form the entire V-twin engine crankcase, including two cylinder mounting structures for mounting the front cylinder and the rear cylinder of the V-twin engine in a co-planar relationship on the crankcase. Disassembly of such a V-twin crankcase, therefore, effectively splits the crankcase along the transverse plane of the cylinders so that the left V-twin crankcase section comprises the left halves of both the front and rear V-twin cylinder mounting structures, and the right crankcase section comprises the right halves of both the front and rear V-twin cylinder mounting structures. It is convenient, therefore, but not essential, that the left crankcase section 82 and the right crankcase section 86 of the example V-quad engine 10 shown in FIGS. 1, 3, and 5 can comprise such conventional standard V-twin left and right crankcase halves 82, 86, which are produced by any of a number of commercial motorcycle engine manufacturers, such as Harley-Davidson Motor Co. The center crankcase section 84, then, can be configured as shown in FIG. 5, to provide additional right halves 88", 90" of the left cylinder mounting structures 88, 90 to mate with the left halves 88', 90' of the left cylinder mounting structures 88, 90 in the left crankcase section 82, and configured to provide additional left halves 92", 94" of the right cylinder mounting structures 92, 94 to mate with the right halves 92', 94' of the right cylinder mounting structures 92, 94 in the right crankcase section 86.

As shown in FIG. 5, the cylinder mounting structures 88, 90, 92, 94 are essentially machined holes in the crankcase 80, which receive mating machined surfaces on the cylinders 12, 14, 16, 18, respectively, to mount the cylinders 12, 14, 16, 18 on the crankcase 80. For example, in FIG. 6, the machined surfaces 15, 19 at the bottoms of the rear cylinders 14, 18, respectively, can be seen seated in the cylinder mounting structures 90, 94 of the crankcase 80.

Referring again to FIG. 5, preferably the left crankcase section 82 and the right crankcase section 86 can be conventional left and right halves of a V-twin engine crankcase, which are commercially available, for example, from Harley-Davidson Motor Co., or they can be fabricated for this application. The left crankcase section 82 comprises the left halves 88', 90' of the left front cylinder mounting structure 88 and the left rear cylinder mounting structure 90, respectively, and the right crankcase section 86 comprises the right halves 92', 94' of the right front cylinder mounting structure 92 and the right rear cylinder mounting structure 94, respectively. The center crankcase section 84 comprises the right halves 88", 90" of the left front cylinder mounting structure 88 and the left rear cylinder mounting structure 90, respectively, and it comprises the left halves 92", 94" of the right front cylinder mounting structure 92 and the right rear cylinder mounting structure 94, respectively.

The assembly of the left crankcase section 82, the center crankcase section 84, and the right crankcase section 86 can be held together by long bolts (not shown) extending through a plurality of aligned holes in those sections 82, 84, 86, several of which holes 96, 98 can be seen in FIG. 5. Such holes in the left and right crankcase sections 82, 86 can be the same as the holes used in conventional V-twin engines to hold the left and right crankcase halves together, if such conventional V-twin left and right crankcase halves are used for the left and right crankcase sections 82, 86 of this example V-quad engine 10, as described above.

The cylinders 12, 14, 16, 18 (not shown in FIG. 5) can be held in the respective cylinder mounting structures 88, 90, 92, 94 by long studs extending from threaded holes in the crankcase 80 through the walls of the cylinders 12, 14, 16, 18, as is well-known in the art. Two of such studs 178', 194' can be seen in FIG. 6, which screw into the threaded holes 178, 194 in the crankcase 80 shown in FIG. 5.

The cylinders 12, 14, 16, 18 (FIG. 1) can also be standard or conventional cylinders for V-twin engines as manufactured, for example, by the Harley-Davidson Motor Co. or other manufacturers, especially if standard or conventional V-twin engine crankcase halves are used for the left and right crankcase sections 82, 86, as explained above, or the cylinders 12, 14, 16, 18 can be specially manufactured for this V-quad engine 10, if desired. If such standard or conventional V-twin engine cylinders are used, the right front and right rear cylinders 16, 18 can be mounted in the crankcase 80 the same as they are mounted in the conventional V-twin engines for which they are made. If standard, commercially available V-twin engine cylinders and right crankcase half are used for the right bank cylinders 16, 18 and for the right crankcase section 86, then other standard V-twin engine parts can also be used, such as the right front and right rear pistons 36, 38, the right front and right rear cylinder heads 104, 106, right front and right rear rocker housings 112, 114, right front and right rear rocker covers 120, 122, right carburetor 126, right intake manifold 130, cam shafts 152 and all cam gears 156, 158, (or, if preferred, cam gears, cam chains, and tighteners), cam bearings, and other cam parts, hydraulic valve lifters 154, push rods, push rod housings 140, 142, 144, 146, ignition rotor 253 and crankshaft or camshaft position sensor 254, and other standard or conventional V-twin engine components, as will become apparent to persons skilled in the art once they understand the principles of this invention. Similarly, the use of a standard or conventional V-twin engine left crankcase half for the left crankcase section 82 of the example V-quad engine 10 also facilitates use of standard or conventional V-twin engine clutch components, electric starter, bearings, seals, primary drive chain and compensation sprockets, flywheel or crankshaft position sensor for ignition systems in which that component is mounted in the V-twin left crankcase half, and other standard or conventional V-twin engine components that are mounted in or on the left crankcase section 82, as will become apparent to persons skilled in the art once they understand the principles of this invention.

If standard or conventional V-twin cylinders are used for the left front and left rear cylinders 12, 14 of the V-quad engine 10 of this invention, it is preferred that a standard or conventional V-twin rear cylinder be rotated 180 degrees about is longitudinal axis and used as the left front cylinder 12 and that a standard or conventional V-twin front cylinder be rotated 180 degrees about its longitudinal axis and used as the left rear cylinder 14. In this manner, another standard or conventional V-twin carburetor 124 and intake manifold 128 can be used for the left carburetor 124 and intake manifold 128 to provide fuel to the left front and left rear cylinders 12, 14. Of course other carburetion or fuel injection systems can also be used, if desired.

Figure 6:
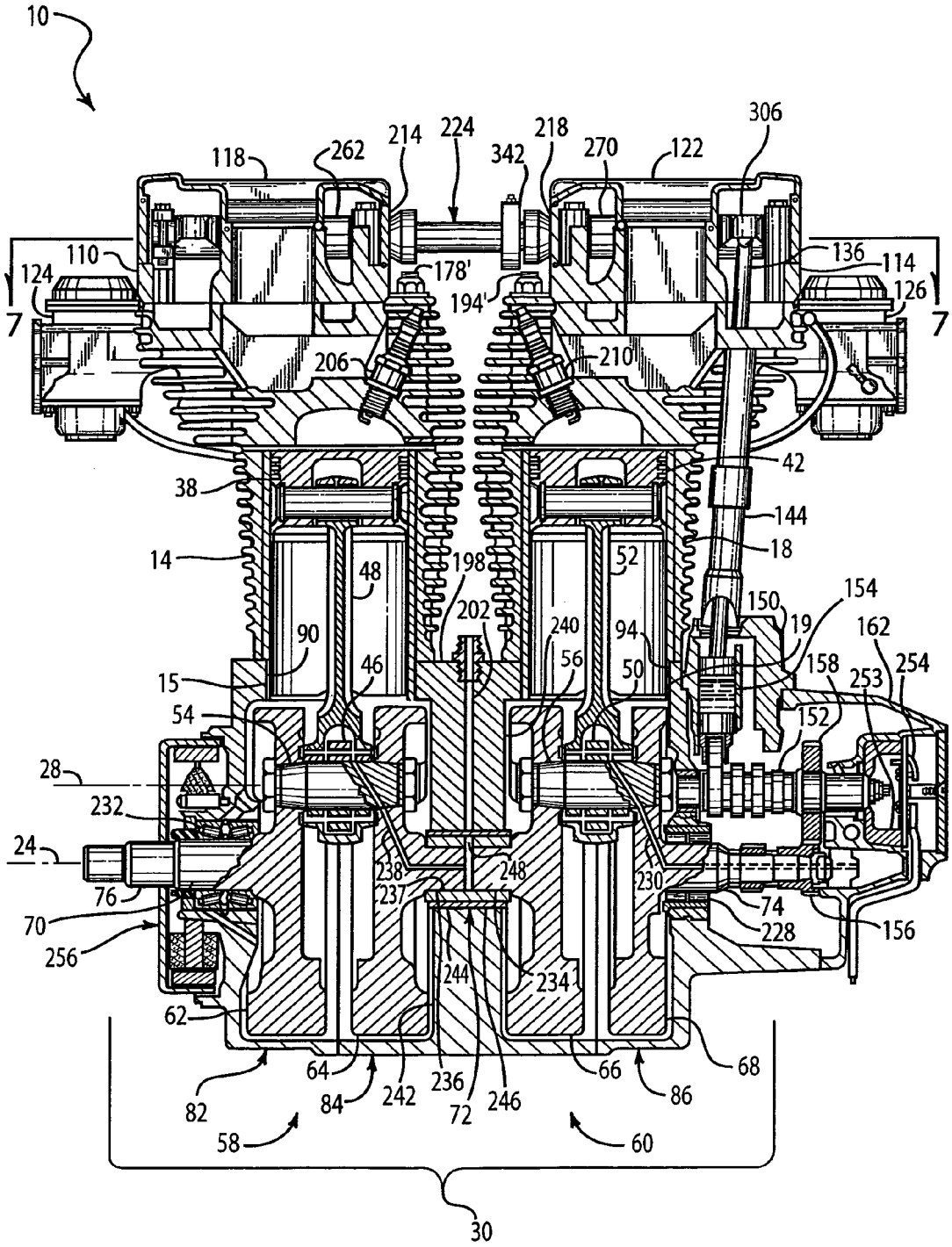
FIG. 6 is a cross-sectional view of the V-quad engine taken along section line 6—6 in FIG. 3.

As mentioned above, the cylinders 12, 14, 16, 18 can be held in place with standard or conventional studs or bolts screwed into the threaded holes in the crankcase 80, which is also conventional for V-twin cylinders. Therefore, for example, such conventional studs (not shown in FIG. 5) for holding the left front cylinder 12 can be screwed into the stud holes 166, 168, 170, 172 in the crankcase 180 disposed around the left front cylinder mounting structure 88, as best seen in FIG. 6. Likewise, stud holes 174, 176, 178, 180 around the left rear cylinder mounting structure 90 can receive studs (not shown) used to hold the left rear cylinder 14 on the crankcase 80, stud holes 182, 184, 186, 188 around the right front cylinder mounting structure 92 can receive studs (not shown) used to hold the right front cylinder 16 on the crankcase 80, and stud holes 190, 192, 194, 196 around the right rear cylinder mounting structure 94 can receive studs (not shown) used to hold the right rear cylinder 18 on the crankcase 80. As mentioned above, two of the studs, 178', 194', can be seen in FIG. 6.

The center crankcase section 84 can be configured with a top separate subsection 198 and a separate bottom subsection 200, which can be held together by bolts or other clamping devices (not shown), to facilitate mounting the crankshaft assembly 30 in the crankcase 80, as will be described in more detail below. An oil duct 202 is provided in the top of the center crankcase section 84 to provide oil to a crankshaft center bearing, which is not shown in FIG. 5, but which will be described in more detail below. Engine mounts 85 can be provided on the engine 10 (both front and rear), if desired, and they can be positioned and sized with holes to match whatever motorcycle frame (not shown) or other mounting structure on which the engine 10 is to be mounted.

Each cylinder 12, 14, 16, 18 is equipped with a cylinder head 100, 102, 104, 106, respectively, which not only encloses the top end of the cylinder, but also contains the intake and exhaust valves, as well as the spark plugs 204, 206, 208, 210, respectively. Rocker housings 108, 110, 112, 114, rocker housing extensions 212, 214, 216, 218, and rocker covers 116, 118, 120, 122 are mounted on the cylinder heads 100, 102, 104, 106, respectively, to contain the intake and exhaust rockers on top of each cylinder head, as will be described in more detail below. If standard or conventional V-twin cylinders are used for the cylinders 12, 14, 16, 18 of the example V-quad engine 10, as described above, then the pistons 36, 38, 40, 42, connecting rods 46, 48, 50, 52, cylinder heads 100, 102, 104, 106, rocker housings 108, 110, 112, 114, and rocker covers 116, 118, 120, 122 can also be standard or conventional V-twin parts. However, the rocker housing extensions 212, 214, 216, 218 are not standard or conventional V-twin parts. They are provided to accommodate modified rocker drive assemblies 220, 222, 224, 226, which are provided as part of the firing system of the V-quad engine 10 of this invention, as will be described in more detail below.

As mentioned above, a firing system is provided and configured to supply and ignite fuel in the two front cylinders 12, 16 simultaneously and to supply and ignite fuel in the two rear cylinders 14, 18 simultaneously in order to mimic the exhaust sound and rhythm of a conventional V-twin engine. The firing system broadly comprises a fuel system and an ignition system. The fuel system delivers the fuel into the left and right front cylinders 12, 16 simultaneously, and it delivers the fuel into the left and right rear cylinders 14, 18 simultaneously. The ignition system ignites the fuel in the left front and right front cylinders 12, 16 simultaneously, and it ignites the fuel in the left rear and right rear cylinders 14, 18 simultaneously. These two systems will be described in more detail below.

Referring now primarily to FIG. 6 with secondary reference to FIG. 2, one example of a suitable crankshaft assembly 30 for the V-quad engine 10 of this invention, can include the left crank and flywheel subassembly 58, which comprises two spaced apart flywheels 62, 64 that are connected together by the eccentric crankpin 54, and it can include the right crank and flywheel subassembly 60, which comprises two spaced apart flywheels 66, 68 that are connected together by the eccentric crankpin 56, as explained above. As also explained above, the connecting rods 46, 48 connect the left bank pistons 36, 38 to the left crankpin 54, and the connecting rods 50, 52 connect the right bank pistons 40, 42 to the right crankpin 56.

If desired, the right crank and flywheel subassembly 60 can be comprised essentially of standard or conventional flywheels 66, 68, crankpin 56, and right crankshaft bearing 228 used in conventional V-twin engines, and the connecting rods 50, 52 and rod bearings between the connecting rods 50, 52 and the crankpin 56 can also be standard or conventional parts used in conventional V-twin engines. As is typical in at least some of such conventional V-twin engines, pressurized oil is provided to the rod bearings by an oil duct 230, which extends longitudinally through the right crankshaft segment, obliquely through the flywheel 68, and obliquely through the crankpin 56 to the rod bearings.

The left crankshaft subassembly 58 can also be comprised substantially of standard or conventional V-twin engine parts, including flywheels 62, 64, crankpin 54, and left crankshaft bearings 232. Also, the left bank pistons 36, 38, connecting rods 46, 48, and the rod bearings between the crankpin 54 and connecting rods 46, 48 can also be standard or conventional V-twin parts, if desired.

In the example crankshaft assembly 30 in FIG. 6, the flywheel 68 is a standard or conventional right flywheel used in at least some V-twin engines, and the flywheel 66 is a standard or conventional left flywheel used in at least some conventional V-twin engines. However, the crankshaft segment 234 protruding axially from the left flywheel of the right crankshaft subassembly 60 is modified by shortening it and machining its peripheral surface to adapt it for joining the right crankshaft subassembly 60 to the left crankshaft subassembly 58, as will be described below.

The flywheels 62, 64 in the left crankshaft subassembly 58 are shown in FIG. 6 as both being standard or conventional left flywheels of a conventional V-twin engine, instead of a standard or conventional V-twin right flywheel paired with a standard or conventional left V-twin flywheel, although a standard or conventional V-twin right flywheel could also be used. The use of a standard or conventional V-twin left flywheel for the right flywheel 64 of the left crankshaft subassembly 58 facilitates joinder of the right crankshaft subassembly 60 to left crankshaft subassembly 58, because it presents a mirror image to the flywheel 66 in the right crankshaft subassembly 60. In this example, the connection of the left crankshaft subassembly 58 to the right crankshaft subassembly 60 can be done by cutting and machining the left crankshaft segment to make a left crankshaft stub 236 to substantially match the right crankshaft stub 234. Then, as shown in FIG. 6, a short steel pipe 237 is shrink-fit onto the two juxtaposed crankshaft stubs 234, 236 to join the right crankshaft subassembly 60 to the left crankshaft subassembly 58 and thereby to form the center crankshaft segment 72. Before such joinder, however, an oil duct 238 is drilled through the flywheel 64 and crankpin 54 to deliver oil under pressure to the rod bearing positioned between the crankpin 54 and the connecting rods 46, 48.

As mentioned above, the center crankcase segment 84 preferably has a top subsection 198 and a bottom subsection 200. The top section 198 includes a top bearing block segment 240 and a bottom bearing block segment 242, which, together, form a center bearing block to mount two center crankshaft bearings 244, 246 to help support and stabilize the center crankshaft segment 72.

The oil duct 202 extends from the top of the center crankcase segment 84 through the top bearing block segment 240 to the center crankshaft bearings 234, 236 to supply oil under pressure to the bearings 234, 236. The pipe 237 of the center crankshaft segment 72 has a hole 248, which allows pressurized oil from the duct 202 into the space between the stub shafts 234, 236, from where it flows through the duct 238 to the rod bearings between the left crankpin and the connecting rods 46, 48. The pressurized oil can be supplied by an external oil tube 250 (not shown in FIG. 6, but shown in FIG. 3) to the oil duct 202. The external oil tube 250 can be tapped into any place there is pressurized oil, such as into the duct that feeds the oil pressure sensor 252 in FIG. 3.

Of course, the structure of the crankshaft assembly 30 shown in FIG. 6 is just one example, and any number of variations may occur to persons skilled in the art once they understand the principles of the invention. For example, the center crankshaft segment 72 could be one solid shaft, either forged or machined with or fastened to the flywheels 64, 66, instead of the stub shafts 234, 236 and heat shrunk pipe 237. Also, more or fewer flywheels could be used, and separate cranks could be provided instead of using the flywheels as cranks. These and other changes or variations could be made by persons skilled in the art within the scope of this invention.

As mentioned above, the use of a standard or conventional right crankcase half of a conventional V-twin engine for the right crankcase segment 86 also accommodates the use of other standard or conventional V-twin parts, such as the front cam shaft 152, hydraulic lifter 154, cam gears 156, 158, camshaft position sensor 254, and cam cover 162, shown in FIG. 6 as well as myriad other standard or conventional V-twin engine parts that are not seen in FIG. 6 or in other figures, but which are well-known to persons skilled in the art. Likewise, the use of a standard or conventional V-twin engine left crankcase half for the left crankcase segment 82 accommodates use of a standard or conventional alternator assembly 256 as well as numerous other standard or conventional V-twin engine parts not seen in FIG. 6.

Figure 4:
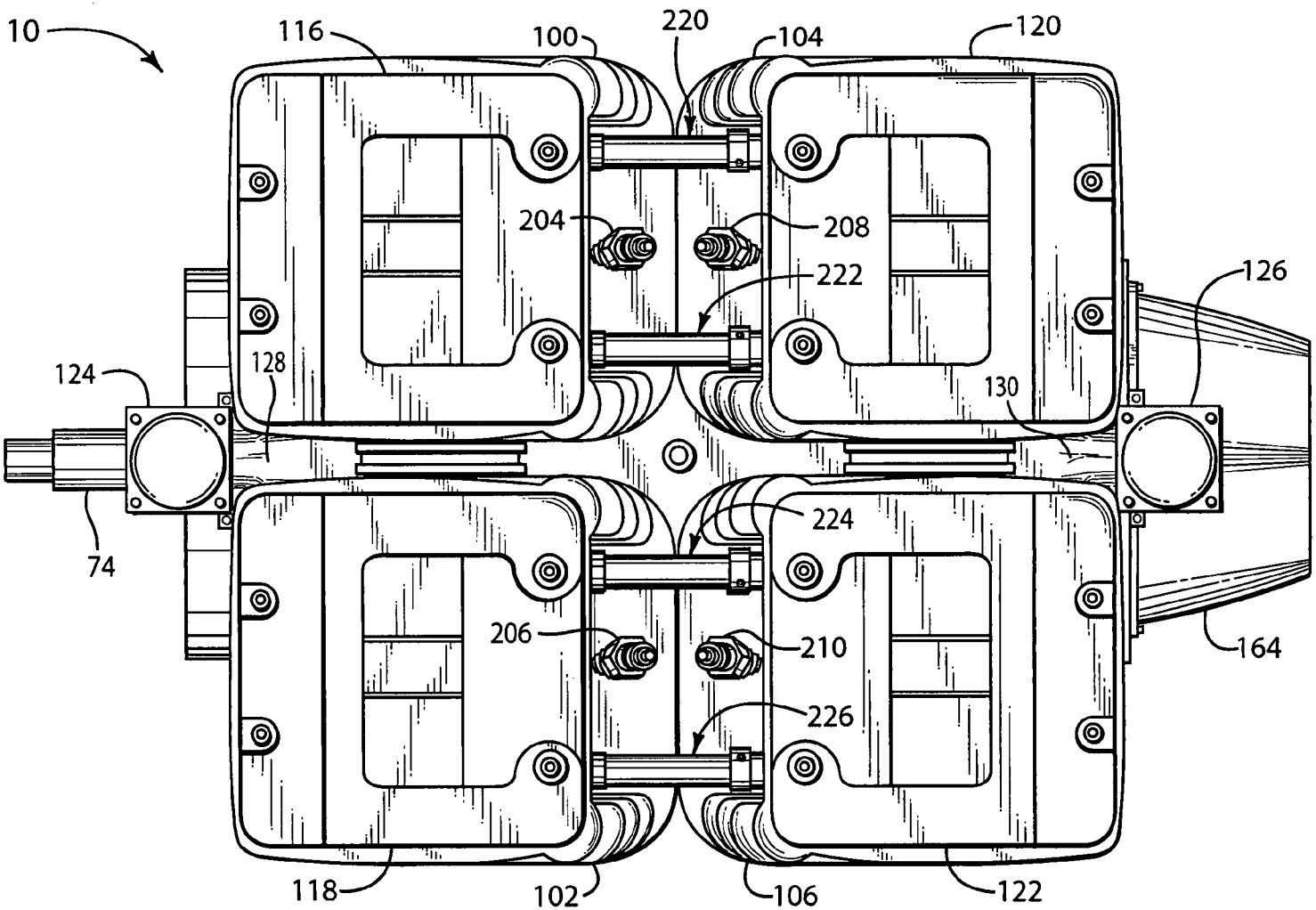
FIG. 4 is a plan view of the V-quad engine in FIG. 1.

As mentioned above, an important feature of this invention is the firing system, which causes the left front and right front cylinders 12, 16 to fire simultaneously and the left rear and right rear cylinders 14, 18 to fire simultaneously. Therefore, the intake valve in the left front cylinder head 100 has to be synchronized to open and close in unison with the intake valves in the right front cylinder head 104, and the exhaust valve in the left front cylinder head 100 has to be synchronized to open and close in unison with the exhaust valve in the right front cylinder head 104. Likewise, the intake and exhaust valves in the left rear cylinder head 102 have to be synchronized to open and close in unison with the intake and exhaust valves, respectively, in the right rear cylinder head 106. One example approach to provide such intake valve synchronization and exhaust valve synchronization according to this invention is to provide the rocker drive assemblies 220, 222, 224, 226 (best seen in FIGS. 4, 6, and 7) to move the intake and exhaust rocker shafts (not shown) for the left front cylinder head 100 in unison and in the same angular alignment with the intake and exhaust rocker shafts (not shown), respectively, for the right front cylinder head 16, and to move the intake and exhaust rocker shafts 262, 264 on the left rear cylinder head 102 in unison and in the same angular alignment with the intake and exhaust rocker shafts 270, 272, respectively, on the right rear cylinder head 106. The rocker shafts for the front cylinder heads 100, 104 are not shown, because they are concealed by the rocker housings and covers 108, 212, 116 and 112, 216, 120, respectively, but they are substantially the same as the rocker shafts 262, 264 and 270, 272, respectively, for the rear cylinder heads 102, 106, which are shown in detail, as will be described below. Preferably, the rocker shafts for the left cylinder heads 100, 102 are made slaves to the rocker shafts for the right cylinder heads 104, 106 so that they move in unison when the push rods move the rocker shafts for the right cylinder heads 104, 106, as will be described in more detail below.

Figure 7:
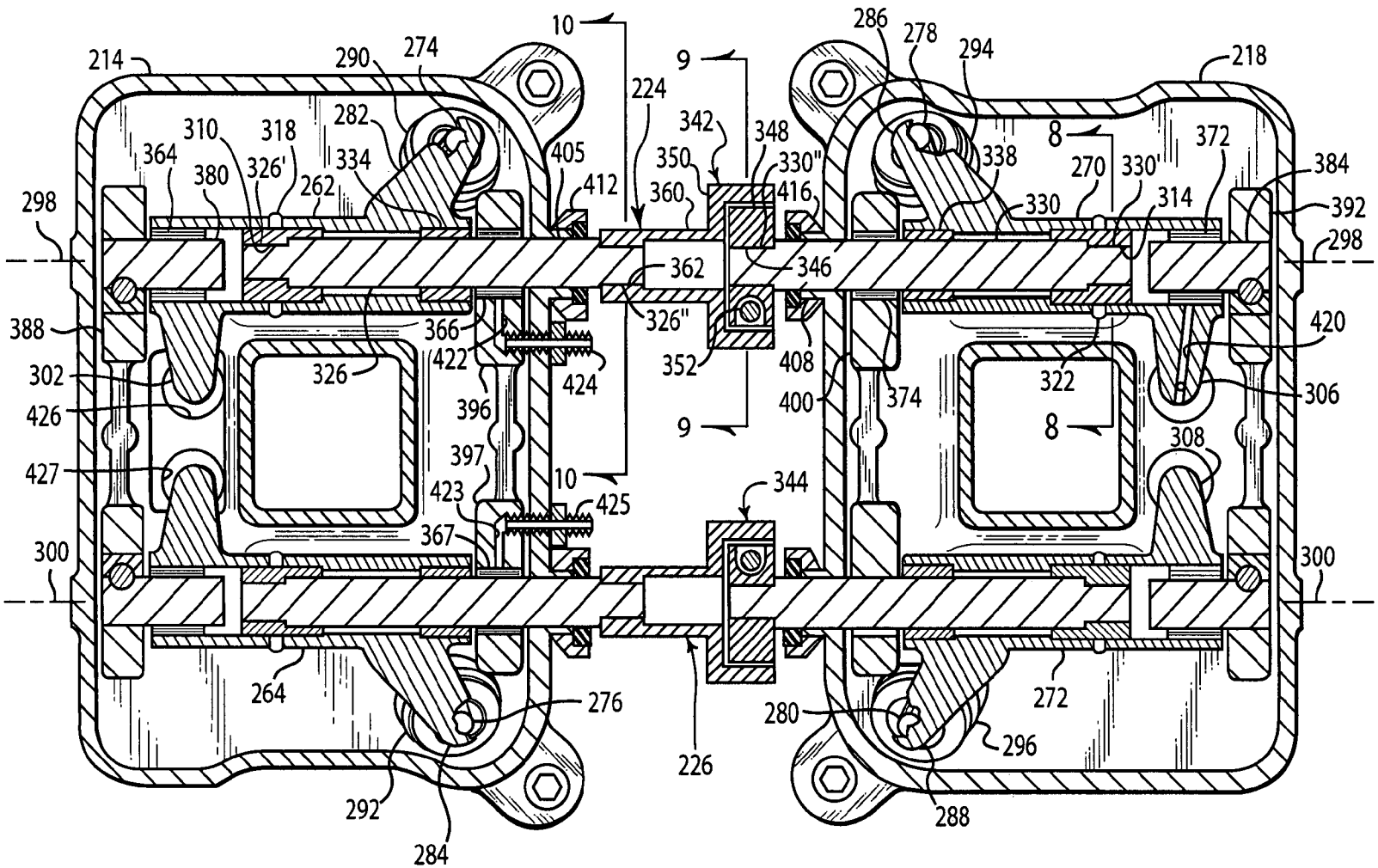
FIG. 7 is a cross-sectional view of the V-quad engine taken along section line 7—7 in FIG. 6.

Referring now primarily to FIG. 7, cross-sectional views of the left rear and right rear rocker housing extensions 214, 218 over the left rear and right rear cylinder heads 14, 18 (not seen in FIG. 7) reveal the rear intake and exhaust rocker drive assemblies 224, 226, which are also in cross-section. As mentioned above, these rear intake and exhaust rocker drive assemblies 224, 226 are essentially the same as the front intake and exhaust rocker drive assemblies 220, 222 (not shown in FIG. 7), so the following description of the rear intake and exhaust rocker drive assemblies also apply to the front intake and exhaust rocker drive assemblies.

In FIG. 7, the intake and exhaust rocker arms 282, 284, 286, 288, which protrude laterally from the respective intake and exhaust rocker shafts 262, 264, 270, 272 are shown with portions of their distal tips cut away to reveal the intake valve stems 274, 278 and exhaust valve stems 276, 280 of the intake and exhaust valves in the left and right rear cylinder heads 102, 106. The intake valve stems 274, 278 of the intake valves in the left rear and right rear cylinder heads 102, 106 protrude into the rocker housings 110, 114 (not visible in FIG. 7), surrounded by intake valve springs 290, 294, respectively. Likewise, the exhaust valve stems 276, 280 of the exhaust valves in the left rear and right rear cylinder heads 102, 106 protrude into the rocker housings 110, 114 surrounded by the exhaust valve springs 292, 296, respectively.

When the left front cylinder 12 and cylinder head 100 are substantially identical to the right rear cylinder 18 and its cylinder head 106, but rotated 180 degrees, and the left rear cylinder 14 and its cylinder head 102 are substantially identical to the right front cylinder 16 and its cylinder head 104, but rotated 180 degrees, as explained above, this configuration advantageously juxtaposes the intake valves and exhaust valves in the cylinder heads 102, 106, and it axially aligns the intake rocker shafts 262, 270 and the exhaust rocker shafts 264, 272 with each other, as best seen in FIG. 7. In other words, the cylinder heads 102, 106 with their respective valves and rocker components are substantially mirror images of each other. While not shown in FIG. 7, this configuration also juxtaposes the front intake valves and front exhaust valves in the front cylinder heads 100, 104 with axial alignment of the front intake rocker shafts with each other and axial alignment of the front exhaust rocker shafts with each other, so that they are also essentially mirror images of each other.

Therefore, this configuration advantageously facilitates connecting the rear intake rocker shafts 262, 270 together to pivot in unison about the rear intake rocker longitudinal axis 298, and thereby to cause the respective rear intake rocker arms 282, 286, which extend laterally from the respective rocker shafts 262, 270 to interact with the respective intake valve stems 274, 278 in unison to open and close the intake valves in the rear cylinder heads 102, 106 simultaneously with each other. Likewise, this configuration facilitates connecting the rear exhaust rocker shafts 264, 272 together to pivot in unison about the rear exhaust rocker longitudinal axis 300 so that the rear exhaust rocker arms 284, 288 actuate the rear exhaust valves in the rear cylinder heads 102, 106 to open and close simultaneously with each other. As mentioned above, these structural advantages and functionalities also apply to the front cylinder 12, 16 components, so that the front intake rocker shafts and front exhaust rocker shafts can be connected together, respectively, to actuate the intake valve in the left front cylinder head 100 to open and close simultaneously with the intake valve in the right front cylinder head 104, and to actuate the exhaust valve in the left front cylinder head 100 to open and close simultaneously with the exhaust valve in the right front cylinder head 104.

The connection together of the front intake rocker shafts, the front exhaust rocker shafts, the rear intake rocker shafts, and the rear exhaust rocker shafts, respectively, as described above, can be accomplished in many ways that would become obvious to persons skilled in the art, once the principles of the invention are understood. An example of such connections is shown in FIG. 7 for the rear cylinder heads 102, 106, which also applies to the front cylinder heads 100, 104, as explained above.

Referring primarily to FIG. 7, therefore, and with secondary reference to FIG. 6, a rear intake rocker drive assembly 224 is provided to connect the left rear intake rocker shaft 262 to the right rear intake rocker shaft 270 so that they pivot in unison about the inlet rocker axis 298. Essentially, the pivoted motion is imparted to the right rear intake rocker shaft 270 by a reciprocating push rod 136 (FIG. 6) acting on the intake rocker drive lever 306 in a conventional manner, and the left rear intake rocker shaft 262 is a slave to the right rear intake rocker shaft 270. Therefore, the rear intake rocker drive assembly 224 transfers that pivotal motion of the right rear intake rocker shaft 270 to the left rear intake rocker shaft 262, thereby making the right rear intake rocker shaft 270 the master and left rear intake rocker shaft 262 the slave. To do so in this example, a right hex drive socket 314 is fastened inside the right rear rocker shaft 270 by plug welds 322 or by some other fastening method, such as adhesive, screw, etc., so that the hex drive socket 314 is not rotatable in relation to the rocker shaft 270. Therefore, pivotal movement of the rocker shaft 270 will transfer the same pivotal movement to the hex drive socket 314.

Figure 8:
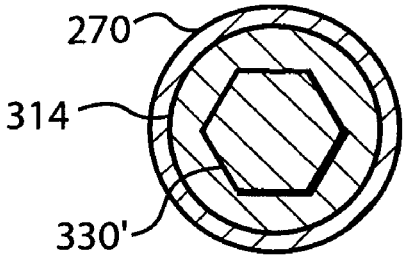
FIG. 8 is a cross-sectional view of a hex drive joint of the rocker drive shaft taken along section line 8—8 in FIG. 7.

Next, a right hex drive shaft 330 with opposite hex ends 330', 330" is inserted longitudinally through a bushing 338 in the end of the rocker shaft 270 and into hex engagement with the hex socket 314, as shown in FIGS. 7 and 8. Therefore, the pivotal motion of the rocker shaft 270 is imparted by the hex socket 314 to the hex drive shaft 330.

Figure 9:
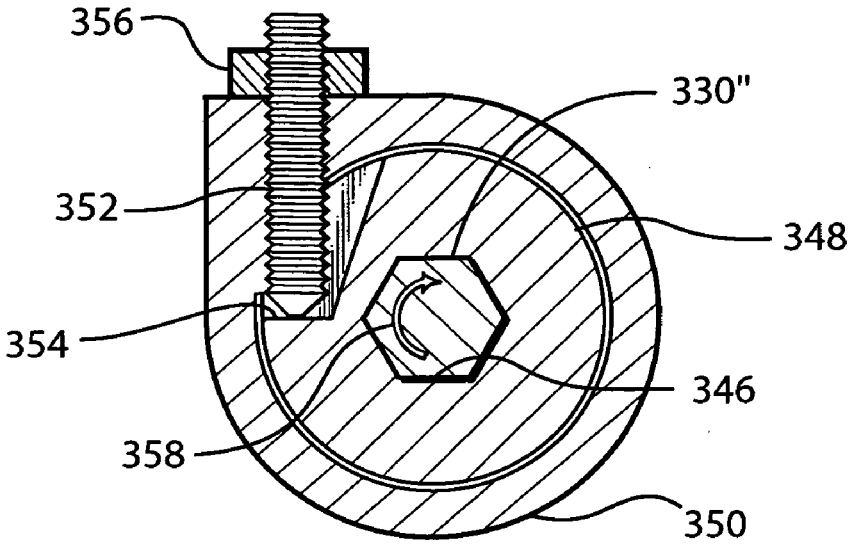
FIG. 9 is a cross-sectional view of the rocker drive shaft adjuster subassembly taken along section line 9—9 in FIG. 7.

An adjustable link 342 is used to connect the right rear intake hex drive shaft 330 with a left rear intake hex drive shaft 326. The adjustable link 342 has a first hex socket 346 in a cylindrical plug 348, which receives the hex and 330" of the hex drive shaft 330, as is also shown in the cross-section view of FIG. 9. The cylindrical plug 348 is rotatably positioned in a cylindrical collar 350, but it is adjustably restrained against rotational movement at least in one direction in relation to the collar by a set screw 352 bearing on a notch surface 354 (FIG. 9) in the plug 348. A lock nut 356 on the set screw 352 can be used to lock the set screw 354 in position. Therefore, with the set screw 354 in a desired position, pivotal movement of the hex drive shaft 330 in the direction of the arrow 358 (FIG. 9), which is the direction required to open the intake valves over the bias of the intake valve springs 290, 294, such pivotal motion is transferred from the hex end 330" of hex drive shaft 330 to the plug 348 and imparted to the collar 350 by the interaction of the set screw 352 and notch surface 354. The set screw 352 does not have to impart motion to the collar 350 in the direction opposite to that indicated by arrow 358, because the intake valve spring 290 will cause the intake valve stem 274 in the left rear cylinder head 102 to push the left rear intake rocker shaft 262 in the direction opposite arrow 358 as soon as the upward force of the push rod 136 is removed from the right rear intake rocker shaft 270, thus also removing the force from the set screw 352.

Figure 10:
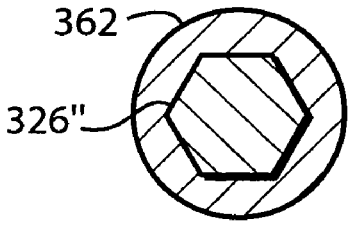
FIG. 10 is a cross-sectional view of another hex drive joint of the rocker drive shaft taken along section line 10—10 in FIG. 7.
Figure 11:
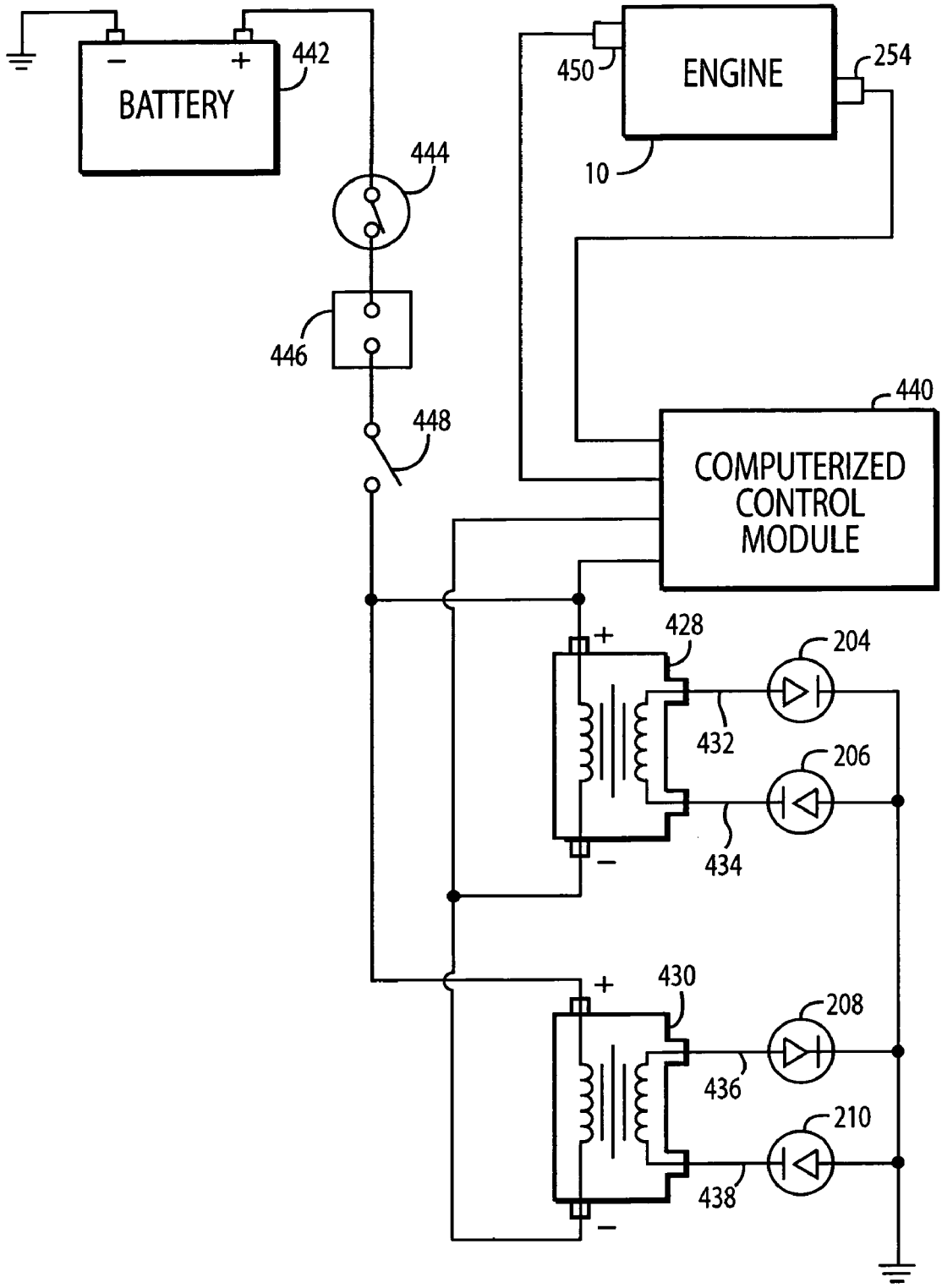
FIG. 11 is a schematic diagram of an electric spark ignition system for the V-quad engine.

An axial extension 360 of the collar 350 has a second hex socket 362 in its distal end, as shown in FIG. 10, which receives a hex end 326" of a left rear intake hex drive shaft 326. Therefore, motion of the collar 350 in the direction of the arrow 358 (FIG. 9) is imparted by the extension 360 of adjustable link 342 to the left rear intake hex drive shaft 326. The left rear intake hex drive shaft 326 is inserted through a bushing 334 into the left rear intake rocker shaft 262, where its other hex end 326' engages a left rear intake hex drive socket 310, which is similar to the drive socket 314 in the right rear intake rocker shaft 270 described above and shown in FIG. 8. The drive socket 310 is affixed to the rocker shaft 262, such as by plug welds 318 or other means (FIG. 7). Therefore, pivotal movement of the hex drive shaft 326 is imparted by the hex drive socket 310 to the left rear intake rocker shaft 262. Of course, such pivotal movement of the rocker shaft 262 results in the rocker arm 282 opening and closing the intake valve in the cylinder head 102.

Therefore, when the push rod 136 (FIG. 7) pushes upwardly on the rocker drive lever 306, it causes the rocker shaft 270 and rocker arm 286 to open the intake valve in the right rear cylinder head 106 in a conventional manner, but, through the rear intake drive assembly 224, it also causes the rocker shaft 262 and rocker arm 282 to simultaneously open the intake valve in the left rear cylinder head 102. Because of tolerances or distortions in the various components of the rocker drive assembly 224, it is possible that the pivotal movement of slave rocker shaft 262 might not be exactly angularly aligned with the pivotal movement of the master rocker shaft 270, thereby causing the intake valves in the respective cylinder heads 102 and 106 to not open and close exactly simultaneously. If so, the angular relationship between the master rocker shaft 270 and the slave rocker shaft 262 can be adjusted in the adjustable link 242 by resetting the set screw 352, and thereby bring the slave rocker shaft 262 back into proper angular alignment with the master rocker shaft 270 to produce the desired simultaneous opening and closing of the intake valves in the cylinder heads 102, 106.

One end of the right rear intake rocker shaft 270 is rotatably mounted and supported by a needle bearing 372 on a rocker shaft pin 384, which is clamped securely in a mounting block 392. The other end of the rocker shaft 270 is supported by the bushing 338 and the hex drive shaft 330, which is itself mounted and rotatably supported in another needle bearing 374 in a pillow block 400. The rocker housing extension 218 includes a boss 408 protruding outwardly and through which the hex drive shaft 330 extends. An oil seal 416 is mounted on the boss 408 and provides a seal around the drive shaft 330 to prevent oil in the rocker housing 114 from escaping.

The left rear intake rocker shaft 262 is also mounted and supported by a needle bearing 364 on a rocker shaft pin 380 clamped in a rocker mounting block 388. The other end of the rocker shaft 262 is supported by the bushing 334 on the drive shaft 326, which itself is supported by another needle bearing 366 in a pillow block 396. An oil seal 412 mounted on a boss 405 protruding from the rocker housing extension 214 seals around the drive shaft 326 to prevent oil in the rocker housing 110 from escaping.

Lubricating oil is pumped under pressure through a longitudinal duct (not shown) in the push rod 136 (FIG. 7) into an oil duct 420 in the rocker lever 306, which directs the oil to the needle bearing 372. The oil then runs into the rocker housing 114, where the rest of the parts in or related to the rocker shaft 270 and drive shaft 330 are lubricated by oil splashing in the rocker housing 114.

Since the left rear rocker shaft 262 is slave driven by the master rocker shaft 270 and rocker drive assembly 224, there is no push rod to supply oil to the needle bearing 364 or to other parts in the left rear rocker housing 214. Therefore, an oil duct 422 is provided in the pillow block 396 to provide oil to the needle bearing 366 and other parts in the left rear rocker housing 110. An external oil tube from a pressurized oil source, such as the tube 250 in FIG. 3, can be connected to the fitting 424 to feed oil into the duct 422.

If the left rear intake rocker shaft 262 is a standard or conventional part used in a conventional V-twin engine, as is illustrated in the example in FIG. 7, then the rocker drive lever 302 is superfluous and has no function, because the rocker shaft 262 is slave-driven by the rocker shaft 270 and rocker drive assembly 224, not by a push rod acting on lever 302. Therefore, the lever 302 can be eliminated if desired, but it can be left as is for convenience. Also, the holes 426, 427 in the left rear rocker housing that accommodates push rods in conventional V-twin engines can be plugged in this V-quad engine application.

The exhaust rocker shafts 264, 272 and the exhaust rocker drive assembly 226 shown in FIG. 7 are essentially mirror images of the intake rocker shafts 262, 272 and intake rocker drive assembly 224 described above, and they function in substantially the same way. Therefore, a full detailed description of all the parts that comprise these exhaust rocker components is not necessary for an understanding of this part of the invention. Suffice it to say that the master exhaust rocker shaft 272, driven by a push rod (concealed by rocker drive lever 308) actuates the exhaust valve in cylinder head 106, and it drives the slave exhaust rocker arm 264 via the rocker drive assembly 226 to actuate the exhaust valve in the cylinder head 102 simultaneously with the actuation of the exhaust valve in the cylinder head 106. If tolerances, distortions, or other factors cause angular misalignment between the master and slave rocker shafts 272, 264 so that simultaneous actuation of the exhaust valves does not occur, the angular relationship between the master and slave exhaust rocker shafts 272, 264 can be adjusted with the adjustable link 344 to attain the desired simultaneous actuation of the exhaust valves.

Another oil fitting 425 is also provided to feed pressurized oil from a pressurized oil source through a duct 423 in the pillow block 397 to the needle bearing 367. Again, the pressurized oil source can be, for example, the tube 250 in FIG. 3.

The ignition system, which ignites the fuel in the left and right front cylinders 12, 16 simultaneously with each other, and which ignites the fuel in the left and right rear cylinders 14, 18 simultaneously with each other, can be comprised of any components that provide these functions. One example ignition system shown schematically in FIG. 12 is a modification of a conventional V-twin engine ignition system that fires the V-twin front and rear cylinders sequentially. It comprises the four spark plugs 204, 206, 208, 210 in the respective cylinder heads 100, 102, 104, 106, as discussed above, and it has two coils 428, 430—one for firing the left cylinder bank spark plugs 204, 206, and the other for firing the right cylinder bank spark plugs 208, 210.

It is conventional in some V-twin engines to fire the spark plugs for both cylinders, front and back, simultaneously from the same coil, even though only one of the two V-twin cylinders at a time has fuel to ignite due to the sequential, not simultaneous, valve timing between the front and rear cylinders. Therefore, in such arrangements, there is a "wasted" spark in one or the other of the cylinders on each revolution of the crankshaft. The example ignition system shown in FIG. 12 maintains that convention by firing all four of the spark plugs 204, 206, 208, 210 simultaneously on each revolution of the crankshaft assembly 30, even though only both front cylinders 12, 16 or only both back cylinders 14, 18 have fuel to ignite on any particular revolution due to the valve operations described above. Therefore, as shown in FIG. 12, the primary sides of the coils 428, 430 are connected in parallel so they are excited simultaneously. Consequently, resulting high tension (voltage) outputs from the coils 428, 430 to the four spark plug wires 432, 434, 436, 438 are simultaneous. Of course, one coil for all four spark plugs could be used instead, or a single coil for each spark plug could be used, to get the same result. A convenience of using the two coils 436, 438, as shown in FIG. 12 is that they can be standard or conventional V-twin engine coils, thus readily available.

The remaining components of the ignition system shown in FIG. 12 can also be standard or conventional V-twin engine parts, including, for example, the rotor 253 and position sensor plate 254 for sensing rotational position of the camshaft 152 (see FIG. 6), the computerized control module 440 for controlling ignition timing and coil excitation, battery 442, ignition switch 444, circuit breaker 446, engine stop switch 448, and vacuum operated electric switch 450 for inputting vacuum indicative of engine load condition to the computerized control module 440. All of these parts and their functions are well-known to persons skilled in the art and are used in the V-quad engine 10 of this invention in much the same way as they are used in conventional V-twin engines, thus they need no further explanation for an understanding of this invention.

There are, of course, many variations and other ignition systems that are well-known for V-twin and other engines that can be adapted for firing the spark plugs of this V-quad engine 10 according to this invention, ranging, for example, from old magneto ignition systems to the newest electronic ignition systems, including some that fire all the spark plugs simultaneously resulting in the "wasted" sparks, as described above, or some that are more controlled to fire individual spark plugs sequentially only when needed to ignite the fuel in a particular cylinder. For the electronic ignition systems, there are myriad position sensors used on conventional V-twin and other engines to detect rotational or angular position of the crankshaft, any of which can be adapted for use in this V-quad engine 10 by persons skilled in the art, once they understand the principles of this invention. A goal, as explained above, is to fire both front cylinders 12, 16 simultaneously and to fire both back cylinders 14, 18 simultaneously, with the front and back cylinders firing in the same sequence and timing as the front and back cylinders of conventional V-twin engines in order to mimic the sound and rhythm of conventional V-twin engines, but with at least twice as many cylinders and the consequent increased total displacement and power that twice as many cylinders provide.

This invention can also use fuel injection to deliver fuel to the cylinders 12, 14, 16 18, instead of the carburetors 124, 126. Fuel injection systems are well-known in the art, and persons skilled in the art would know how to use them in this invention, once they understand the principles of this invention.

The foregoing description is considered as illustrative of the principles of the invention. Furthermore, since numerous modifications and changes will readily occur to those skilled in the art, it is not desired to limit the invention to the exact construction and process shown and described above. Accordingly, resort may be made to all suitable modifications and equivalents that fall within the scope of the invention. The words "comprise," "comprises," "comprising," "include," "including," and "includes" when used in this specification are intended to specify the presence of stated features, integers, components, or steps, but they do not preclude the presence or addition of one or more other features, integers, components, steps, or groups thereof.

The invention claimed is:

1. A V-type engine, comprising:

a crankshaft with a longitudinal axis;

two cylinder banks, each of which comprises two cylinders with respective longitudinal axes that are oriented to form a "V" in a plane that is perpendicular to the longitudinal axis of the crankshaft, and each of which cylinders contains a piston that is moveable in a reciprocating manner in the cylinder and that is connected by a connecting rod to the crankshaft, and further where the longitudinal axis of one of the cylinders in one of the cylinder banks is in a common plane with the longitudinal axis of the crankshaft and with the longitudinal axis of one of the cylinders in the other cylinder bank; and a firing system which causes fuel to ignite simultaneously in the cylinders in which the respective longitudinal axes are co-planar with each other and with the longitudinal axis of the crankshaft.

2. A V-type engine, comprising:

a crankshaft that is rotatable about a crankshaft longitudinal axis, said crankshaft having an eccentric common crank axis parallel to the crankshaft longitudinal axis;

a left front cylinder with a left front longitudinal axis and a left rear cylinder with a left rear longitudinal axis, wherein the left front cylinder and the left rear cylinder are oriented such that the left front longitudinal axis and the left rear longitudinal axis form a V in a left cylinder bank plane that is perpendicular to the crankshaft longitudinal axis;

a left front piston in the left front cylinder and a left rear piston in the left rear cylinder, wherein the front piston is moveable in a reciprocating manner along the left front longitudinal axis and the left rear piston is moveable in a reciprocating manner along the left rear longitudinal axis, and wherein the left front piston and the left rear piston are both connected to the crankshaft at the common crank axis by a left front connecting rod and a left rear connecting rod, respectively;

a right front cylinder with a right front longitudinal axis and a right rear cylinder with a right rear longitudinal axis, wherein the right front cylinder and the right rear cylinder are oriented such that the right front longitudinal axis and the right rear longitudinal axis form a V in a right cylinder bank plane that is perpendicular to the crankshaft longitudinal axis and spaced apart from the left cylinder bank plane, and, further, wherein the left front longitudinal axis and the right front longitudinal axis are in a common front cylinder plane and the left rear longitudinal axis and the right rear longitudinal axis are in a common rear cylinder plane;

a right front piston in the right front cylinder and a right rear piston in the right rear cylinder, wherein the right front piston is moveable in a reciprocating manner along the right front longitudinal axis and the right rear piston is moveable in a reciprocating manner along the right rear longitudinal axis, and wherein the right front piston and the right rear piston are both connected at the crank axis to the crankshaft by a right front connecting rod and a right rear connecting rod, respectively; and a firing system which causes fuel to explode simultaneously in the left front cylinder and in the right front cylinder, and which causes fuel to explode simultaneously in the left rear cylinder and in the right rear cylinder.

3. The V-type engine of claim 2, wherein the firing system includes a fuel system that delivers fuel into the left front cylinder and the right front cylinder simultaneously and that delivers fuel into the left rear cylinder and right rear cylinder simultaneously.

4. The V-type engine in claim 3, wherein the firing system includes an ignition system that ignites fuel in the left front cylinder and the right front cylinder simultaneously and that ignites fuel in the left rear cylinder and the right rear cylinder simultaneously.

5. The V-type engine of claim 4, wherein the fuel system includes a left front intake valve positioned to allow the fuel into the left front cylinder, a right front intake valve positioned to allow the fuel into the right front cylinder, a left rear intake valve positioned to allow the fuel into the left rear cylinder, and a right rear intake valve positioned to allow the fuel into the right rear cylinder.

6. The V-type engine of claim 5, including an exhaust system comprising a left front exhaust valve positioned to allow exhaust gases to flow out of the left front cylinder, a right front exhaust valve positioned to allow exhaust gases to flow out of the right front cylinder, a left rear exhaust valve positioned to allow exhaust gases to flow out of the left rear cylinder, and a right rear exhaust valve positioned to allow exhaust gas to flow out of the right rear cylinder.

7. The V-type engine of claim 6, wherein the fuel system also includes:

a left front intake rocker shaft positioned adjacent the left front intake valve with a left front intake rocker arm that interacts with the left front intake valve in such a manner that pivotal movement of the left front intake rocker shaft about a left front intake rocker shaft axis causes the left front intake valve to open to allow fuel to flow into the left front cylinder and then to close during ignition of the fuel;

a left front exhaust rocker shaft positioned adjacent the left front exhaust valve with a left front exhaust rocker arm that interacts with the left front exhaust valve in such a manner that pivotal movement of the left front exhaust rocker shaft about a left front exhaust rocker shaft axis causes the left front exhaust valve to open to allow exhaust gas to flow out of the left front cylinder after the fuel is ignited and then to close;

a right front intake rocker shaft positioned adjacent the right front intake valve with a right front intake rocker arm that interacts with the right front intake valve in such a manner that pivotal movement of the right front intake rocker shaft about a right front intake rocker shaft axis causes the right front intake valve to open to allow fuel to flow into the right front cylinder and then to close during ignition of the fuel;

a right front exhaust rocker shaft positioned adjacent the right front exhaust valve with a right front exhaust rocker arm that interacts with the right front exhaust valve in such a manner that pivotal movement of the right front exhaust rocker shaft about a right front exhaust rocker shaft axis causes the right front exhaust valve to open to allow exhaust gas to flow out of the right front cylinder after the fuel is ignited and then to close;

a left rear intake rocker shaft positioned adjacent the left rear intake valve with a left rear intake rocker arm that interacts with the left rear intake valve in such a manner that pivotal movement of the left rear intake rocker shaft about a left rear intake rocker shaft axis causes the left rear intake valve to open to allow fuel to flow into the left rear cylinder and then to close during ignition of the fuel; and a left rear exhaust rocker shaft positioned adjacent the left rear exhaust valve with a left rear exhaust rocker arm that interacts with the left rear exhaust valve in such a manner that pivotal movement of the left rear exhaust rocker shaft about a left rear exhaust rocker shaft axis causes the left rear exhaust valve to open to allow exhaust gas to flow out of the left rear cylinder after the fuel is ignited and then to close;

a right rear intake rocker shaft positioned adjacent the right rear intake valve with a right rear intake rocker arm that interacts with the right rear intake valve in such a manner that pivotal movement of the right rear intake rocker shaft about a right rear intake rocker shaft axis causes the right rear intake valve to open to allow fuel to flow into the right rear cylinder and then to close during ignition of the fuel; and a right rear exhaust rocker shaft positioned adjacent the right rear exhaust valve with a right rear exhaust rocker arm that interacts with the right rear exhaust valve in such a manner that pivotal movement of the right rear exhaust rocker shaft about a right rear exhaust rocker shaft axis causes the right rear exhaust valve to open to allow exhaust gas to flow out of the right rear cylinder after the fuel is ignited and then to close.

8. The V-type engine of claim 7, wherein:

the left front intake rocker shaft and the right front intake rocker shaft are connected together in such a manner that they pivot in unison to open and close both the left front intake valve and the right front intake valve simultaneously;

the left front exhaust rocker shaft and the right front exhaust rocker shaft are connected together in such a manner that they pivot in unison to open and close both the left front exhaust valve and the right front exhaust valve simultaneously;

the left rear intake rocker shaft and the right rear intake rocker shaft are connected together in such a manner that they pivot in unison to open and close both the left rear intake valve and the right rear intake valve simultaneously; and the left rear exhaust rocker shaft and the right rear exhaust rocker shaft are connected together in such a manner that they pivot in unison to open and close both the left rear exhaust valve and the right rear exhaust valve simultaneously.

9. The V-type engine of claim 8, wherein:

the connection of the left front intake rocker shaft and the right front intake rocker shaft is adjustable;

the connection of the left front exhaust rocker shaft and the right front exhaust rocker shaft is adjustable;

the connection of the left rear intake rocker shaft and the right rear intake rocker shaft is adjustable; and the connection of the left rear exhaust rocker shaft and the right rear exhaust rocker shaft is adjustable.

10. The V-type engine of claim 8, wherein the ignition system includes a left front spark plug positioned adjacent the left front intake valve where it can ignite the fuel in the left front cylinder, a right front spark plug positioned adjacent the right front intake valve where it can ignite the fuel in the right front cylinder, a left rear spark plug positioned adjacent the left rear intake valve where it can ignite the fuel in the left rear cylinder, a right rear spark plug positioned adjacent the right rear intake valve where it can ignite the fuel in the right rear cylinder, a high voltage source, a left front spark plug wire connecting the high voltage source to the left front spark plug, a left rear spark plug wire connecting the high voltage source to the left rear spark plug, a right front spark plug wire connecting the high voltage source to the right front spark plug, a right rear spark plug wire connecting the high voltage source to the right rear spark plug, and a high voltage distribution system that distributes high voltage from the high voltage source to both the left front spark plug and the right front spark plug simultaneously and that distributes high voltage from the high voltage source to both the left rear spark plug and the right rear spark plug simultaneously.

11. The V-type engine of claim 10, wherein the high voltage source comprises a first coil and a second coil, wherein the right front spark plug and the right rear spark plug are connected by the right front spark plug wire and the right rear spark plug wire, respectively, to the first coil, and wherein the left front spark plug and the left rear spark plug are connected by the left front spark plug wire and the left rear spark plug wire, respectively, to the second coil.

12. The V-type engine of claim 10, including:

a left front cylinder head mounted on the left front cylinder, wherein the left front intake valve, the left front exhaust valve, and the left front spark plug are mounted in said left front cylinder head, and wherein the left front intake rocker shaft and the left front exhaust rocker shaft are mounted on the left front cylinder head adjacent the left front intake valve and the left front exhaust valve, respectively;

a right front cylinder head mounted on the right front cylinder, wherein the right front intake valve, the right front exhaust valve, and the right front spark plug are mounted in said right front cylinder head, and wherein the right front intake rocker shaft and the right front exhaust rocker shaft are mounted on the right front cylinder head adjacent the right front intake valve and the right front exhaust valve, respectively;

a left rear cylinder head mounted on the left rear cylinder, wherein the left rear intake valve, the left rear exhaust valve, and the left rear spark plug are mounted in said left rear cylinder head, and wherein the left rear intake rocker shaft and the left rear exhaust rocker shaft are mounted on the left rear cylinder head adjacent the left rear intake valve and the left rear exhaust valve, respectively; and a right rear cylinder head mounted on the right rear cylinder, wherein the right rear intake valve, the right rear exhaust valve, and the right rear spark plug are mounted in said right rear cylinder head, and wherein the right rear intake rocker shaft and the right rear exhaust rocker shaft are mounted on the right rear cylinder head adjacent the right rear intake valve and the right rear exhaust valve, respectively.

13. The V-type engine of claim 12, wherein:

the left front cylinder head and the right front cylinder head are positioned along side each other with the left front intake rocker shaft axis coincident with the right front intake rocker shaft axis and with the left front exhaust rocker shaft axis coincident with the right front exhaust rocker shaft axis, and wherein the connection of the left front intake rocker shaft and the right front intake rocker shaft includes a front intake rocker drive assembly extending between and connected to the left front intake rocker shaft in the left front cylinder head and the right front intake rocker shaft in the right front cylinder head; and the left rear cylinder head and the right rear cylinder head are positioned along side each other with the left rear intake rocker shaft axis coincident with the right rear intake rocker shaft axis and with the left rear exhaust rocker shaft axis coincident with the right rear exhaust rocker shaft axis, and wherein the connection of the left rear intake rocker shaft and the right rear intake rocker shaft includes a rear intake rocker drive assembly extending between and connected to the left rear intake rocker shaft in the left rear cylinder head and the right rear intake rocker shaft in the right rear cylinder head.

14. The V-type engine of claim 13, wherein:

the front intake rocker drive assembly is angularly adjustable;

the front exhaust rocker drive assembly is angularly adjustable;

the rear intake rocker drive assembly is angularly adjustable; and the rear exhaust rocker drive assembly is angularly adjustable.

15. The V-type engine of claim 14, including:

a left front rocker box assembly mounted on the left front cylinder head, wherein the left front intake rocker shaft and the left front exhaust rocker shaft are mounted by the left front rocker box assembly on the left front cylinder head adjacent the left front intake valve and the left front exhaust valve, respectively;

a right front rocker box assembly mounted on the right front cylinder head, wherein the right front intake rocker shaft and the right front exhaust rocker shaft are mounted by the right front rocker box assembly on the right front cylinder head adjacent the right front intake valve and the right front exhaust valve, respectively;

a left rear rocker box assembly mounted on the left rear cylinder head, wherein the left rear intake rocker shaft and the left rear exhaust rocker shaft are mounted by the left rear rocker box assembly on the left rear cylinder head adjacent the left rear intake valve and the left rear exhaust valve, respectively; and a right rear rocker box assembly mounted on the right rear cylinder head, wherein the right rear intake rocker shaft and the right rear exhaust rocker shaft are mounted by the right rear rocker box assembly on the right rear cylinder head adjacent the right rear intake valve and the right rear exhaust valve, respectively.

16. The V-type engine of claim 15, wherein:

the front intake rocker drive assembly includes: (i) a left front intake rocker drive shaft angularly engaged with the left front intake rocker shaft and extending out of the left front rocker box assembly toward the right front rocker box assembly; (ii) a right front intake rocker drive shaft angularly engaged with the right front intake rocker shaft and extending out of the right front rocker box assembly toward the left front rocker box assembly; and (iii) an angularly adjustable link connecting the left front intake rocker drive shaft to the right front intake rocker drive shaft;

the front exhaust rocker drive assembly includes: (i) a left front exhaust rocker drive shaft angularly engaged with the left front exhaust rocker shaft and extending out of the left front rocker box assembly toward the right front rocker box assembly; (ii) a right front exhaust rocker drive shaft angularly engaged with the right front exhaust rocker shaft and extending out of the right front rocker box assembly toward the left front rocker box assembly; and (iii) an angularly adjustable link connecting the left front exhaust rocker drive shaft to the right front exhaust rocker drive shaft;

the rear intake rocker drive assembly includes: (i) a left rear intake rocker drive shaft angularly engaged with the left rear intake rocker shaft and extending out of the left rear rocker box assembly toward the right rear rocker box assembly; (ii) a right rear intake rocker drive shaft angularly engaged with the right rear intake rocker shaft and extending out of the right rear rocker box assembly toward the left rear rocker box assembly; and (iii) an angularly adjustable link connecting the left rear intake rocker drive shaft to the right rear intake rocker drive shaft; and the rear exhaust rocker drive assembly includes: (i) a left rear exhaust rocker drive shaft angularly engaged with the left rear exhaust rocker shaft and extending out of the left rear rocker box assembly toward the right rear rocker box assembly; (ii) a right rear exhaust rocker drive shaft angularly engaged with the right rear exhaust rocker shaft and extending out of the right rear rocker box assembly toward the left rear rocker box assembly; and (iii) an angularly adjustable link connecting the left rear exhaust rocker drive shaft to the right rear exhaust rocker drive shaft.

17. The V-type engine of claim 16, including:

a left front intake rocker drive shaft bearing and a left front intake rocker shaft seal in the left front rocker box assembly, wherein the left front intake rocker drive shaft extends through the left front intake rocker drive shaft bearing for support and through the left front intake rocker shaft seal, which prevents oil leakage along the left front intake rocker drive shaft from inside the rocker box assembly;

a left front exhaust rocker drive shaft bearing and a left front exhaust rocker shaft seal in the left front rocker box assembly, wherein the left front exhaust rocker drive shaft extends through the left front exhaust rocker drive shaft bearing for support and through the left front exhaust rocker shaft seal, which prevents oil leakage along the left front exhaust rocker drive shaft from inside the rocker box assembly;

a right front intake rocker drive shaft bearing and a right front intake rocker shaft seal in the right front rocker box assembly, wherein the right front intake rocker drive shaft extends through the right front intake rocker drive shaft bearing for support and through the right front intake rocker shaft seal, which prevents oil leakage along the right front intake rocker drive shaft from inside the rocker box assembly;

a right front exhaust rocker drive shaft bearing and a right front exhaust rocker shaft seal in the left front rocker box assembly, wherein the right front exhaust rocker drive shaft extends through the right front exhaust rocker drive shaft bearing for support and through the right front exhaust rocker shaft seal, which prevents oil leakage along the right front exhaust rocker drive shaft from inside the rocker box assembly;

a left rear intake rocker drive shaft bearing and a left rear intake rocker shaft seal in the left rear rocker box assembly, wherein the left rear intake rocker drive shaft extends through the left rear intake rocker drive shaft bearing for support and through the left rear intake rocker shaft seal, which prevents oil leakage along the left rear intake rocker drive shaft from inside the rocker box assembly;

a left rear exhaust rocker drive shaft bearing and a left rear exhaust rocker shaft seal in the left rear rocker box assembly, wherein the left rear exhaust rocker drive shaft extends through the left rear exhaust rocker drive shaft bearing for support and through the left rear exhaust rocker shaft seal, which prevents oil leakage along the left rear exhaust rocker drive shaft from inside the rocker box assembly;

a right rear intake rocker drive shaft bearing and a right rear intake rocker shaft seal in the right rear rocker box assembly, wherein the right rear intake rocker drive shaft extends through the right rear intake rocker drive shaft bearing for support and through the right rear intake rocker shaft seal, which prevents oil leakage along the right rear intake rocker drive shaft from inside the rocker box assembly; and a right rear exhaust rocker drive shaft bearing and a right rear exhaust rocker shaft seal in the right rear rocker box assembly, wherein the right rear exhaust rocker drive shaft extends through the right rear exhaust rocker drive shaft bearing for support and through the right rear exhaust rocker shaft seal, which prevents oil leakage along the right rear exhaust rocker drive shaft from inside the rocker box assembly.

18. The V-type engine of claim 2, wherein the crankshaft includes a left crank and flywheel subassembly and a right crank and flywheel subassembly, and further wherein:

the left crank and flywheel subassembly includes two juxtaposed flywheels spaced apart axially from each other along the crankshaft longitudinal axis with an eccentric left crankpin extending between and connecting the two flywheels together to define a left crank axis, said left front connecting rod and said left rear connecting rod being connected to the crankshaft by the left crankpin;

the right crank and flywheel subassembly includes two juxtaposed flywheels spaced apart axially from each other along the crankshaft longitudinal axis with an eccentric right crankpin extending between and connecting the two flywheels together to define a right crank axis, said right front connecting rod and said right rear connecting rod being connected to the crankshaft by the right crankpin; and wherein the left crank and flywheel subassembly and the right crank and flywheel subassembly are spaced apart axially from each other along the crankshaft longitudinal axis and are connected together with the left crank axis aligned with the right crank axis and thereby to form the eccentric common crank axis to rotate in unison about the crankshaft longitudinal axis by a center crankshaft section that extends between the left crank and flywheel subassembly and the right crank and flywheel subassembly along the crankshaft longitudinal axis.

19. The V-type engine of claim 18, including a center bearing assembly positioned between the left crank and flywheel subassembly and the right crank and flywheel subassembly for support of the center crankshaft section.

20. The V-type engine of claim 18, wherein:

the left crank and flywheel subassembly includes a left stub shaft extending axially toward the right crank and flywheel subassembly;

the right crank and flywheel subassembly includes a right stub shaft extending axially toward the left crank and flywheel subassembly; and the center crankshaft section includes a tube that is positioned between the respective left and right crank and flywheel subassemblies with the respective left and right stub shafts extending into opposite ends of the tube, and wherein the tube is attached to the left and right stub shafts.

21. For a V-type engine that has a bank of two co-planar front and back cylinders with their respective longitudinal axes together forming a V in a plane that is transverse to a crankshaft longitudinal axis and that has a piston in each of the two cylinders connected by respective connecting rods to a crankshaft at a crank axis that is eccentric to the crankshaft longitudinal axis, and that has a front cylinder head with a front intake valve, a front exhaust valve, and a front spark plug mounted on the front cylinder and a rear cylinder head with a rear intake valve, a rear exhaust valve, and rear spark plug mounted on the rear cylinder, and, further, that has front intake and exhaust rocker shafts with front intake and exhaust rocker arms, respectively, mounted on the front cylinder head adjacent the front intake and front exhaust valves, respectively, and rear intake and exhaust rocker shafts with rear intake and exhaust rocker arms, respectively, mounted on the rear cylinder head adjacent the rear intake and rear exhaust valves, respectively, a method of increasing displacement while maintaining substantially the same exhaust sound and similar side profile appearance of the V-type engine comprising:

extending the crankshaft longitudinally;

positioning a second bank of two additional co-planar front and back cylinders with their respective longitudinal axes together forming a second V in a second plane that is transverse to the crankshaft longitudinal axis and that has two additional pistons, one in each of the two additional cylinders;

connecting the two additional pistons with two respective additional connecting rods to the extended crankshaft at the same eccentric crank axis;

mounting an additional front cylinder head with an additional front intake valve, an additional front exhaust valve, and an additional front spark plug on the additional front cylinder;

mounting an additional rear cylinder head with an additional rear intake valve, an additional rear exhaust valve, and an additional rear spark plug on the additional rear cylinder;

mounting an additional front intake rocker shaft with an additional front intake rocker arm on the additional front cylinder head adjacent the additional front intake valve in a manner such that pivotal movement of the additional front intake rocker shaft interacts with the additional front intake valve to open and close the additional front intake valve;

mounting an additional front exhaust rocker shaft with an additional front exhaust rocker arm on the additional front cylinder head adjacent the additional front exhaust valve in a manner such that pivotal movement of the additional front exhaust rocker shaft interacts with the additional front exhaust valve to open and close the additional front exhaust valve;

mounting an additional rear intake rocker shaft with an additional rear intake rocker arm on the additional rear cylinder head adjacent the additional rear intake valve in a manner such that pivotal movement of the additional rear intake rocker shaft interacts with the additional rear intake valve to open and close the additional rear intake valve;

mounting an additional rear exhaust rocker shaft with an additional rear exhaust rocker arm on the additional rear cylinder head adjacent the additional rear exhaust valve in a manner such that pivotal movement of the additional rear exhaust rocker shaft interacts with the additional rear exhaust valve to open and close the additional rear exhaust valve;

connecting the front intake rocker shafts together so that they pivot in unison to open and close the front intake valves simultaneously;

connecting the front exhaust rocker shafts together so that they pivot in unison to open and close the front exhaust valves simultaneously;

connecting the rear intake rocker shafts together so that they pivot in unison to open and close the rear intake valves simultaneously;

connecting the rear exhaust rocker shafts together so that they pivot in unison to open and close the rear exhaust valves simultaneously; and configuring a high voltage spark distribution system to deliver high voltage charge to the front spark plugs simultaneously to ignite fuel in the front cylinders simultaneously and to deliver high voltage charge to the rear spark plug simultaneously to ignite fuel in the rear cylinders simultaneously.

22. The method of claim 21, including using substantially duplicates of the cylinders of the V-twin engine for the additional cylinders, but mounting them in such a manner that they are rotated 180 degrees so that the additional cylinders are juxtaposed in substantially mirror images to the cylinder of the V-twin engine.

23. The method of claim 22, wherein the V-twin engine has a crankcase with two cylinder mounting structures that can be split along the transverse plane of the front and back cylinders, including:

splitting the crankcase of the V-twin engine along the transverse plane through the two cylinder mounting structures into a left crankcase section with a left half of each of the two cylinder mounting structures and a right crankcase section with a right half of each of the two cylinder mounting structures;

adding a center crankcase section that provides two additional right halves of cylinder mounting structures that mate with the two left halves of the two cylinder mounting structures in the left crankcase section and two additional left halves of cylinder mounting structures that mate with the two right halves of the two cylinder mounting structures in the right crankcase section, so that, with the center crankcase section mounted between the left and right crankcase sections, there are two left bank cylinder mounting structures and two right bank cylinder mounting structures; and mounting the two cylinders of the V-twin engine in the two right bank cylinder mounting structures, and mounting the two additional cylinders in the two left bank cylinder mounting structures.

24. The method of claim 21, wherein the crankshaft of the V-twin engine includes a crank and flywheel assembly with an eccentric crankpin extending between two flywheels to define the eccentric crank axis where the connecting rods connect the pistons to the crankshaft, including extending the crankshaft by:

providing an additional crank and flywheel assembly with an additional eccentric crankpin extending between two additional flywheels; and attaching the additional crank and flywheel assembly longitudinally to the crankshaft with the additional eccentric crankpin aligned with the eccentric crank axis.

* * * * *